US005542520A

United States Patent [19]

Beisel et al.

[11] Patent Number: 5,542,520

[45] Date of Patent: Aug. 6, 1996

[54] COIN TESTING APPARATUS

[75] Inventors: Weinfried Beisel, Wilnsdorf; Hans-Michael Schwarz, Talwiesenweg 8, D-76307 Karlsbad; Bodo Morgenstern, Am Strauch 2, D-35041 Marburg-Wehrshausen, all of Germany

[73] Assignees: Grabener Pressensysteme GmbH & Co. KG, Netphen; Hans-Michael Schwarz, Karlsbad; Bodo Morgenstern, Marburg-Wehrshausen, all of Germany

[21] Appl. No.: 259,426

[22] Filed: Jun. 14, 1994

[30] Foreign Application Priority Data

Jun. 18, 1993 [DE] Germany ..... 43 20 123.7

[51] Int. Cl.[6] ..... G07D 5/02

[52] U.S. Cl. ..... 194/335; 453/4

[58] Field of Search ..... 194/328, 334, 194/335; 453/4, 55

[56] References Cited

U.S. PATENT DOCUMENTS

| | | | |
|---|---|---|---|
| 3,486,511 | 12/1969 | Salvessen | 453/55 |
| 3,537,560 | 11/1970 | Secunda . | |
| 4,082,099 | 4/1978 | Iwersen | 453/4 |
| 4,089,400 | 5/1978 | Gregory, Jr. | 194/335 X |
| 4,988,256 | 1/1991 | Smith et al. | 414/416 |
| 5,090,576 | 2/1992 | Menten | 209/639 X |
| 5,220,986 | 6/1993 | Winkler, III . | |

FOREIGN PATENT DOCUMENTS

| | | | |
|---|---|---|---|
| 2716740 | 10/1978 | Germany . | |
| 3416045 | 4/1984 | Germany . | |
| 3332911 | 3/1985 | Germany . | |
| 3335384 | 4/1985 | Germany . | |
| 3335385 | 4/1985 | Germany . | |
| 1470779 | 4/1977 | United Kingdom . | |
| 2010559 | 10/1978 | United Kingdom | 194/335 |
| 2028778 | 3/1980 | United Kingdom . | |
| 2123196 | 1/1984 | United Kingdom | 194/335 |

OTHER PUBLICATIONS

Machine Moderne, Jun. 1959; pp. 10–17.
Metalworking Production; Sep. 11, 1963; pp. 90–93.

*Primary Examiner*—F. J. Bartuska
*Attorney, Agent, or Firm*—Panitch, Schwarze, Jacobs & Nadel, P.C

[57] ABSTRACT

A testing apparatus is provided for round discs, for example coins, in which the discs move along a supporting guide past at least one gauge. The round discs are fed onto an inclined chute surface from which they slide down and onto a collecting track, of which there is at least one, that is inclined with respect to the horizontal and that collects the discs and guides them away along a supporting guide. Thereafter, the discs are sent to an optoelectronic device for measurement of their diameters and/or thicknesses. This apparatus makes possible throughputs that are significantly higher than those of the previously known testing apparatuses.

26 Claims, 5 Drawing Sheets

COIN TESTING APPARATUS

FIELD OF THE INVENTION

The invention relates to a testing apparatus for round discs, preferably of the same dimensions, in which the discs move on a guide that supports them at the circumference and on at least one side, and go past at least one gauge. Whenever discs are mentioned herein, is meant round or polygonal discs, blanks, possibly with raised edges, minted coins, washers, or similar engineering discs.

BACKGROUND OF THE INVENTION

Testing apparatuses of this type are used to check coins or coin blanks in various processing stages for dimensional accuracy, particularly with regard to diameter, thickness, roundness and flatness, as well as for completeness of form. Previously, these tests have occurred immediately before or after the machine that carries out the individual processing step, for example a coining press. Since coining presses that type work at the time at a stroke rate of less than 1000 strokes per minute, the previously known testing apparatuses with their mechanical gauges and calibers, in particular, were still sufficient in terms of their performance.

What is disadvantageous with these, however, is the fact that each individual machine must be provided with its own testing apparatus which, as a result of the high degree of precision with which the gauges must be manufactured, significantly increases the price of the machine. It would be beneficial in this case to be able to operate several presses together with just one testing apparatus. However, the performance of the known testing apparatuses is not sufficient to do that. In addition, the testing accuracy leaves something to be desired.

SUMMARY OF THE INVENTION

It is therefore an object of the present invention to provide a testing apparatus by means of which a substantially higher operational throughput can be achieved. This testing apparatus should also be reliable in its operation, subject to little wear, and easy to convert to other sizes of discs.

These objects are achieved in accordance with the present invention by connecting ahead of the disc guide an inclined chute surface, onto which the discs can be fed from a lying position above, and along which runs at least one collecting track that is inclined with respect to the horizontal and that transitions into the guide at its lower lying end.

The invention has the advantage that a large quantity of discs that are fed to the testing apparatus in a basically random way can be received and processed. The coins or the like slide down the inclined chute surface under their own weight, and are collected by the inclined collecting track from the vertical movement and conveyed off to the side. When the number of incoming discs increases to the point that the collecting track can no longer accept all of the discs and guide them off to the side, then the discs begin to topple over and to fall off the collecting track. They then fall back onto the inclined chute surface and can be received there by an additional track that can be provided for these discs that have overshot, and these can then be guided off to the side in the same way.

The discs that are not caught by the second track either then fall into an overflow channel at the lower end of the chute surface, from which channel they are again fed from above to the inclined chute surface by means of a conveying apparatus. The discs that have been caught by the collecting track begin to roll as a result of the downward incline of the collecting track, which brings about the high throughput of the testing apparatus in accordance with the invention.

In order that the sliding and rolling of the round discs bring about as high a throughput as possible, it is helpful if the chute surface is inclined at an angle between 10° and 70° relative to the perpendicular, and if the collecting track is inclined at an angle between 10° and 60° relative to the horizontal. It is possible to attain an especially uniform throughput if the inclination of the chute surface is about 25°, and if the inclination of the collecting track is about 30°.

In addition, it is also beneficial if the collecting track has a width that is smaller than the radius of the discs but greater than their thickness. In this way it is possible to receive many discs, and such discs as do topple over when they strike the collecting track, fall off or over the collecting track, and thus do not hinder the continuous rolling of the remaining discs. In addition, the collecting track can have at its lower lying end a separating section that has a width that is less than or equal to the disc thickness. If two discs directly alongside one another roll off the collecting track, then the separating section brings about the separation of these two discs so that just one continues along the collecting track while the other falls away to the bottom.

Since the collecting track is matched to the discs in terms of its thickness, it is beneficial to secure it to the chute surface in a detachable and exchangeable fashion or to make it adjustable to the particular coin dimensions in question. This makes it possible for the apparatus to be easily converted to round discs of differing dimensions.

In addition, the collecting track can have areas in which recesses have been made on the side that faces the chute surface, so that dirt that is being carried along with the round discs can fall down behind the track and thus leave the smooth running of the round discs undisturbed.

In addition to that, in the region of the collecting track there are provided pneumatically controlled blowing jets that are activated at intervals in order to remove the dirt that is building up. The disc that has been separated in the separating section then runs through a testing station.

With the known testing stations, the coin runs through a series of gauges and calibers that are formed by means of slots or bored holes. So that these gauges and calibers function reliably and separate out with certainty individual discs with faulty measurements from the overall quantity of discs, the total flow past these gauges cannot be very high. In order to ensure the desired throughput in the case of a diameter gauge, a diameter gauge in accordance with the invention has two strips of light-sensitive elements, which are arranged on one side of the plane of the discs and essentially parallel to the plane in such a way that at least one of the strips runs essentially along the guide. In addition, this diameter gauge in accordance with the invention includes a light source that is arranged on the opposite side of the plane of the discs and casts parallel light onto the light-sensitive elements. The round discs that are rolling along the guide cast a shadow onto the light-sensitive elements, and thereby generate signals that are processed by an evaluation unit.

When this is done, it is especially beneficial when one of the strips is arranged parallel to the part of the guide that supports the discs at their circumference, and the other is arranged approximately at a right angle to the first strip. In this case, the diameter can be calculated in an especially simple way from the endpoints of the shadow that is cast by the disc onto the light-sensitive element strips. However, even if the light-sensitive element strips are parallel with one another or lie at any other desired angle relative to one another, the diameter of the disc that is passing by the gauge can be determined from the above-mentioned endpoints. For this purpose, the light source can either send out flashes of light, or else the light-sensitive elements can only record their signals for a brief period; whereby smearing of the shadow, as a result of the movement of the disc during the optical integration period, can be prevented.

In addition, it is also advantageous if the distance (height) from the part of the guide that supports the discs at their circumference to the strip of light-sensitive elements that runs parallel to the guide part is less than ⅘ of the disc diameter. In this way, it can be ensured that discrete measurement values are obtained without a glancing intersection.

In cases where a thickness gauge is to be integrated into the testing apparatus, then this thickness gauge can have at least one measurement system that, for one thing, can comprise a strip of optoelectronic, light-sensitive elements arranged either above or below the guide and perpendicular to the plane of the discs, as well as a second strip arranged on the other side of the guide and parallel to the first strip, the second strip having several light sources that cast parallel light on the light-sensitive elements via a projection lens, and an evaluation unit that processes the signals generated by the light-sensitive elements. Since these parallel beams of light that are generated by these light sources are always displaced from one another in terms of angle, they shine around the disc, which casts a shadow in each of these beams, and the shadow width is detected by the light-sensitive elements.

If the disc is canted with respect to one of these beams of light, then the measured width is enlarged relative to the actual width. Only the smallest measured width of the disc corresponds to the actual width. In this way, it is possible to compensate for a wobbling movement of the disc to be measured. In order to separate the individual parallel beams of light so that a definite determination of the width can be made, it is best to have the individual light sources flash one after the other and then to read the result from the strip of light-sensitive elements and evaluate it.

In place of a strip with individual light-sensitive detectors, a single, continuous detector can also be used, which works in an analogous fashion. Similarly, the detectors can also be arranged in an area-related way, and in particular, in a system of polar coordinates.

The parallel beams of light must be able to pass unhindered from the light source to the light-sensitive elements in the region of the side edges of the discs, apart from the discs themselves. To do this, it is necessary to provide appropriate recesses in the chute surface and in the guide.

In addition, in order to obtain a faster measurement or the redundancy of several measurements, the thickness gauge can include at least two measuring systems that are arranged at an angle to one another.

In order to sort out the discs that have been found to have an faulty dimension, it is beneficial if the testing apparatus has an ejection unit at the end of each of one or more gauges, whereby in accordance with an ejection unit embodiment of the invention an air jet is arranged in the region of the part of the guide that supports the discs at the side. By means of a blast of air through one of these jets, a disc that is moving past it can be pushed off the track so that it falls into a reject collection pit that is assigned to this ejection unit. It can also be expedient to eject coins by means of electromagnets that generate eddy currents. Aside from that, the guide ends at a collecting box for "good" discs, from which the discs can be conveyed to a further processing line or to the final inspection or packaging.

BRIEF DESCRIPTION OF THE DRAWINGS

The foregoing summary, as well as the following detailed description of a preferred embodiment of the invention, will be better understood when read in conjunction with the appended drawings which show further features and advantages of the invention. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE PREFERRED EMBODIMENT

Figure 1:
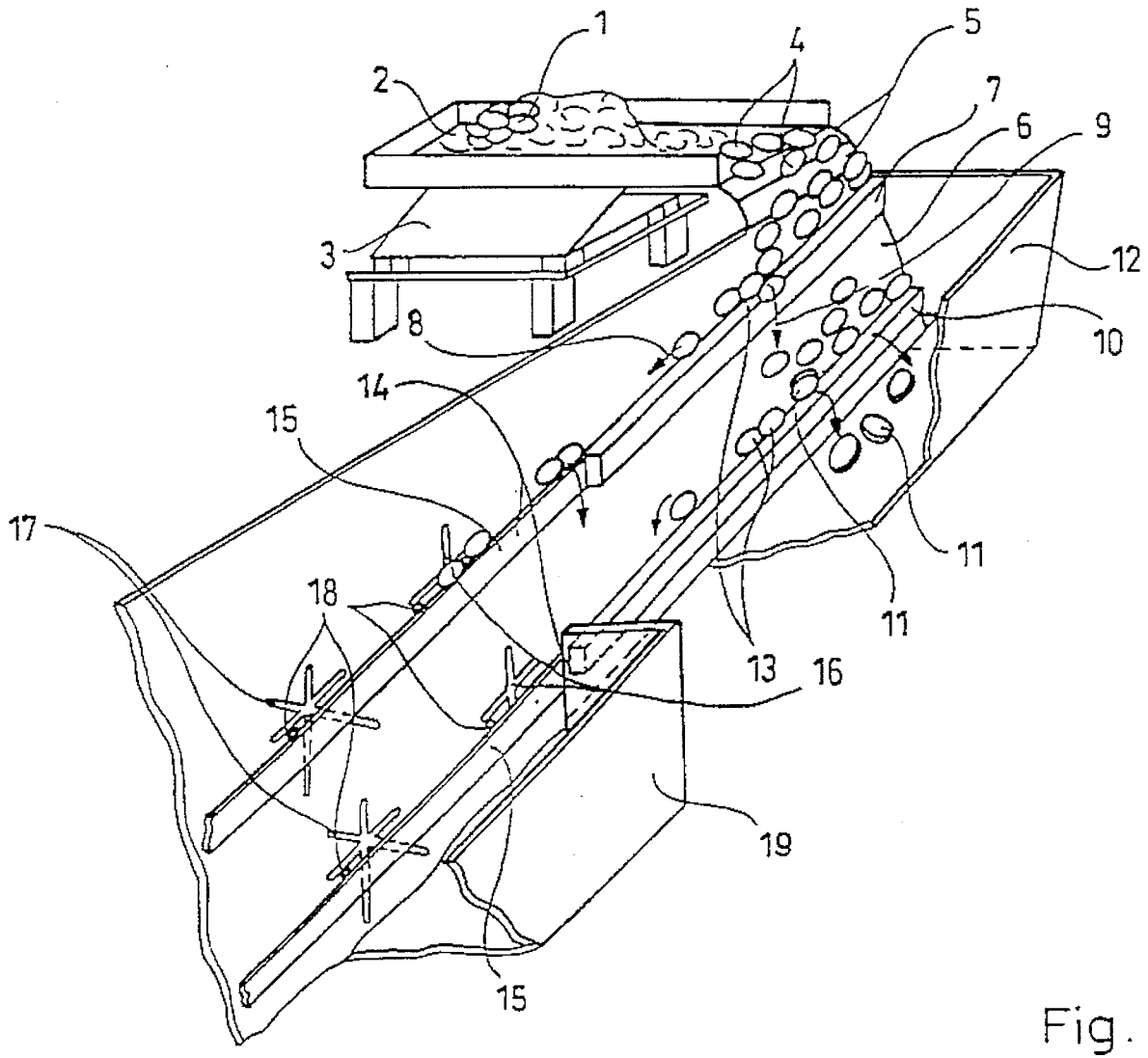
FIG. 1 shows a partial perspective view of a testing apparatus in accordance with the invention.

FIG. 1 shows a testing apparatus in accordance with the invention. The round or polygonal discs to be tested, which can be punched blanks, blanks with raised edges, or a finish-minted coin, or can just as well be washers or other engineering discs, lie randomly in a feed hopper 1 on a vibrating conveyor 2. This vibrating conveyor 2 is set into slight vibration in a known manner by a vibration drive 3 so that the discs 4 disengage from the feed hopper 1 and, basically lying next to one another, slide over the transfer panel 5 and onto a chute surface 6. This chute surface 6 is inclined at about 25° with respect to the vertical. The discs 4 slide down this chute surface 6 until they encounter a collecting track 7, which is arranged on the chute surface 6 so that it is downwardly inclined therefrom.

On this collecting track 7, the discs 4 make a transition from the sliding to the rolling state, and roll sideways down the collecting track 7, as is shown by the arrow 8. There are some discs that, for any number of reasons, are not held by the collecting track 7. They jump over the collecting track 7, by toppling over for example (arrow 9).

They then land again on the chute surface 6, and can accordingly roll away sideways on a second collecting track 10, which is attached to the chute surface 6 below and parallel to the collecting track 7. Discs 11 that are not held by the second collecting track 10 fall into an overflow trough 12, from which they are transported back to the vibrating conveyor 2 by means of a conveyor apparatus that is not shown.

In the case of the coins that are rolling along the collecting tracks 7, 10, it can happen that two discs 13 move directly alongside each other. In order that these two discs do not move simultaneously through the gauges and calibers that are connected after the collecting tracks, these collecting tracks 7, 10 have at their lower-lying ends separating sections 14 that have the same thickness (width) as an individual disc.

Discs that roll down the collecting tracks 7, 10 directly against the chute surface 6 continue to roll down the separating sections, while discs that are moving along next to these first discs have the support removed from underneath them in these separating sections, and consequently fall into the overflow trough 12, from where they are again transported to the vibrating conveyor 2 and then the chute surface 6.

After the discs have been separated in the manner described, they roll or slide for their sorting on a guide 15 past a diameter gauge 16 and a thickness gauge 17 that are indicated only by means of coordinate axes. If in these gauges it is determined that the diameter or the thickness of the tested disc does not match the desired values, then, by means of air jets 18 that are built into the chute surface 6 at the end of the gauges 16, 17, the disc is displaced by means of a blast of air so that it falls from the guide 15 into a reject collection pit 19. Otherwise, the discs move along to the end of the guide 15 and can be conveyed from there to the next processing stage or the final inspection, etc.

Figure 2:
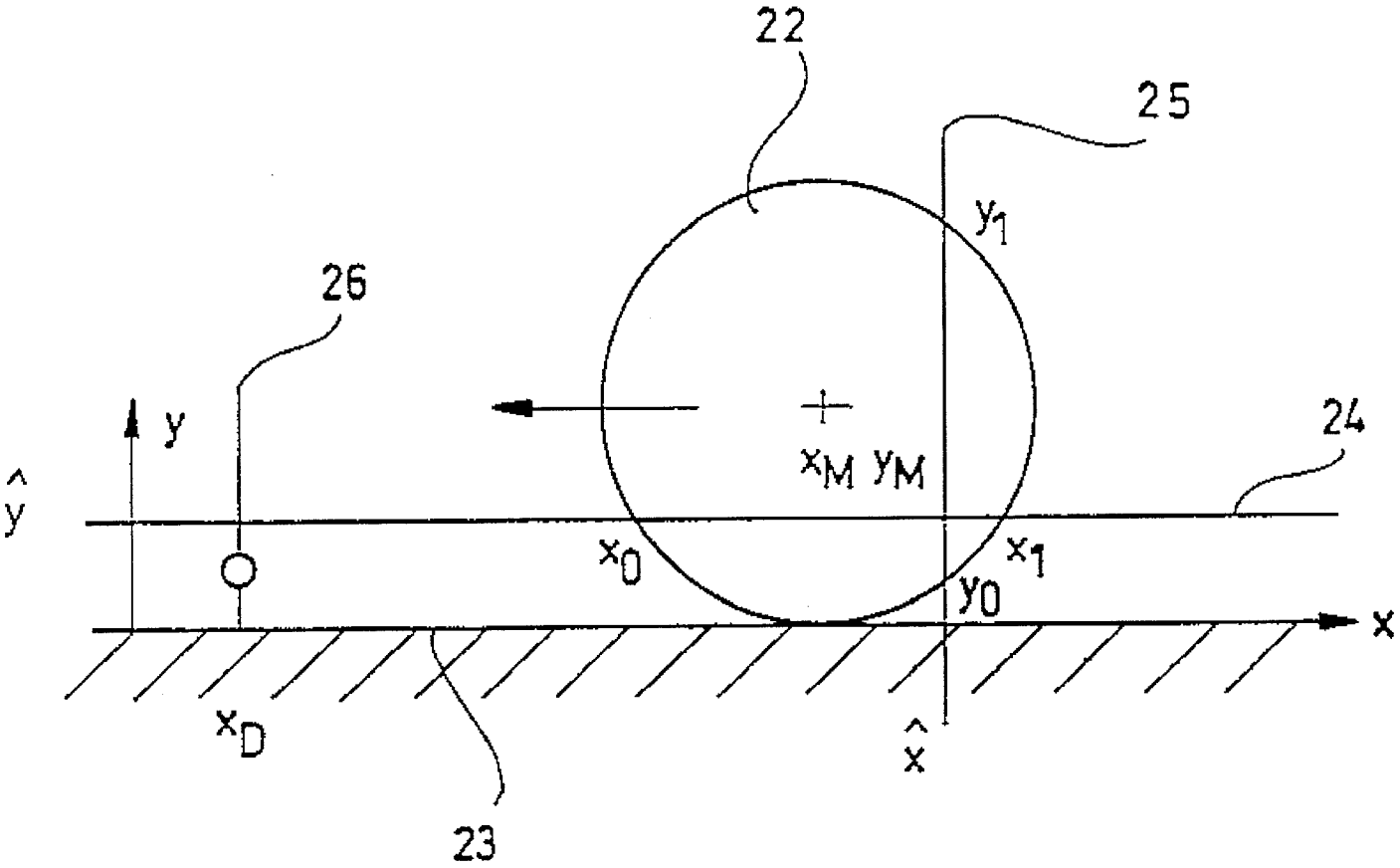
FIG. 2 is a schematic diagram showing the principle of a diameter gauge in accordance with the invention.
Figure 3:
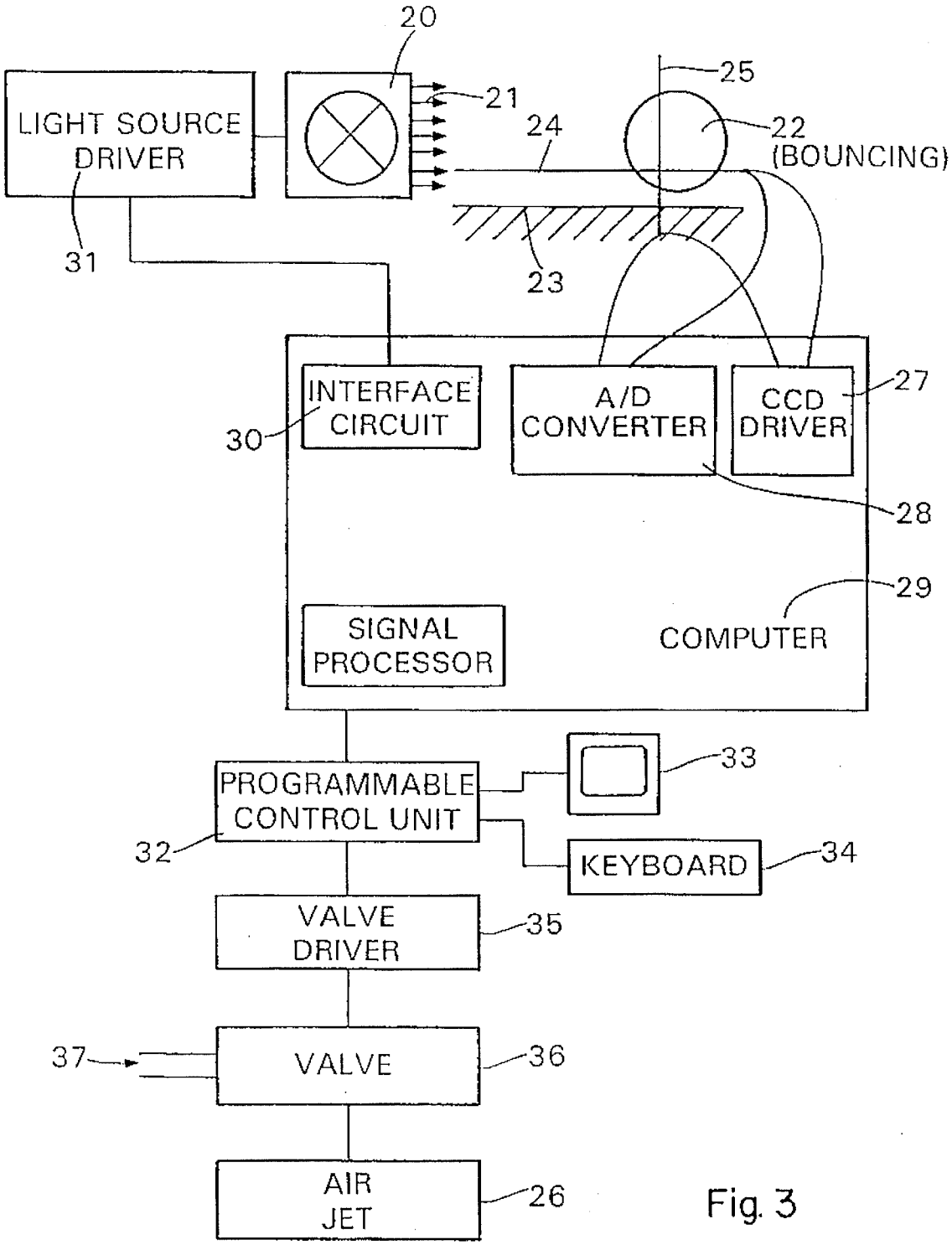
FIG. 3 shows a circuit diagram of a diameter gauge in accordance with the invention.

The principle of the diameter gauge 16 can be seen from FIGS. 2 and 3. Shown in FIG. 3 is the way in which a light source 20 casts parallel light 21 on a disc 22 that is moving along a guide 23 in front of two strips of light-sensitive elements 24, 25. These strips 24, 25 are shown in more detail in FIG. 2. The strip 24 runs at a constant distance $\hat{Y}$ from the guide 23, and the strip 25 runs at a right angle to that at the location $\hat{X}$. By means of the shadows that are cast by the disc 22 on the strips 24, 25, the points $X_0$ and $X_1$ plus $Y_0$ and $Y_1$ result. From that, the location of the mid-point $(X_M, Y_M)$ can be directly calculated:

$$X_M = \frac{(X_0 + x_1)}{2} \; ; \; Y_M = \frac{(Y_0 + Y_1)}{2}$$

The mid-point can also be determined by means of a differential calculation. From this it follows:

$$\bar{r} = \frac{1}{4}\left(\sqrt{(X_M - X_0)^2 + (Y_M - \hat{Y})^2} + \sqrt{(X_M - X_1)^2 + (Y_M - \hat{Y})^2} + \sqrt{(X_M - \hat{X})^2 + (Y_M - Y_0)^2} + \sqrt{(X_M - \hat{X})^2 + (Y_M - Y_1)^2}\right)$$

Since $$\frac{\delta \bar{r}}{\delta X_M} = 0$$

$$\frac{\delta \bar{r}}{\delta Y_M} = 0$$

two equations are obtained for the unknowns $X_M$ and $Y_M$.

In addition, the following apply for calculation of the two mid-points:

$$r_{00} = \sqrt{(X_M - X_0)^2 + (Y_M - \hat{Y})^2} \; ;$$

$$r_{10} = \sqrt{(X_M - X_1)^2 + (Y_M - \hat{Y})^2} \; ;$$

$$r_{01} = \sqrt{(X_M - \hat{X})^2 + (Y_M - Y_0)^2} \; ;$$

-continued $$r_{11} = \sqrt{(X_M - \hat{X})^2 + (Y_M - Y_1)^2}$$

All four values $r_{00}$ through $r_{11}$ must match the desired radius of the disc within the predetermined tolerances, or else the disc 22 is blown from the guide 23 by the blast of air 26 when it reaches the position $X_D$.

The strips 24 and 25 can be arranged directly behind the discs 22 in such a way that the discs 22 cast a shadow on the strips 24 and 25. Alternatively, the discs 22 can be projected onto the panels 24 and 25 by means of a lens.

The individual parts that make up the diameter gauge are shown in FIG. 3. The strips of light-sensitive elements 24 and 25, which can be CCD strips, are triggered by a driver 27. The signals generated by the strips 24, 25 as a result of the parallel light 21 are then converted by means of an analog-digital converter 28 and sent to a computer 29 with a signal processor. This computer 29 also contains an interface circuit 30, by means of which a light source driver 31 can be triggered, which controls the light source 20. The light source 20 gives off flashes of light with a duration such that the signal picked up by the CCD strips is not blurred by over-charging.

To the computer with the signal processor there is connected a programmable control unit 32 that has a monitor 33 and a keyboard 34 by means of which it can be programmed. The programmable control unit 32 controls a valve driver 35 by means of which a valve 36 can be opened, through which compressed air 37 is fed for the air jet 26, which functions in the manner described above.

Figure 4A:
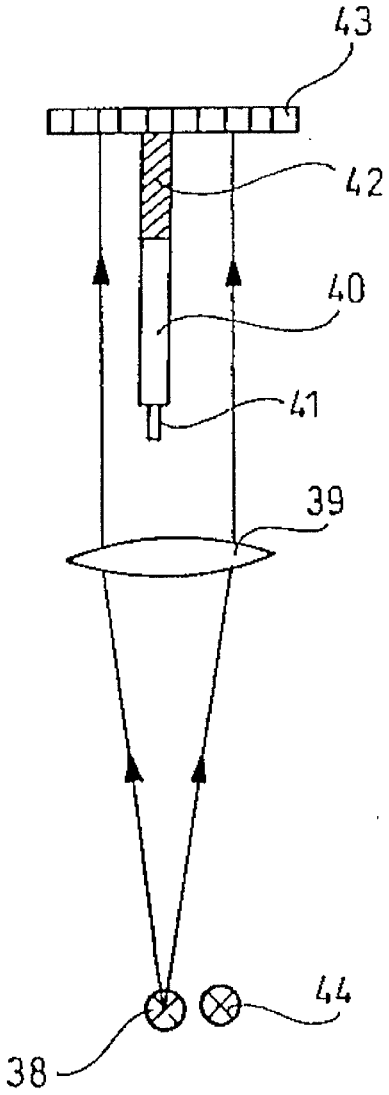
FIG. 4*a*, 4*b* are schematic diagrams showing the principle of a diameter gauge in accordance with the invention.
Figure 4B:
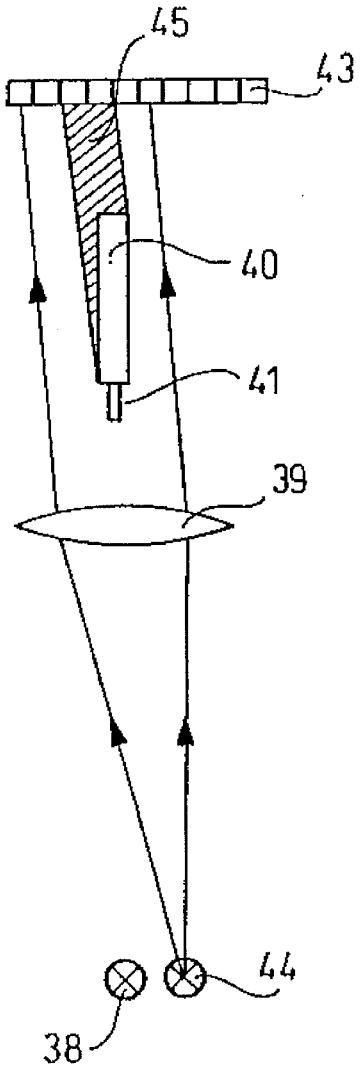

For the thickness measurement, there is a similar control unit whose function is diagrammed in FIG. 4. From a light source 38 light is cast through a lens 39, whereby the lens 39 makes the light parallel. This parallel light strikes a disc 40 that is moving along a guide 41. As a result, the disc 40 casts a shadow 42 on a strip of light-sensitive elements 43 that is placed perpendicular to the plane of the disc. The thickness of the disc 40 can be determined by an evaluation of the signals given off by the light-sensitive elements.

In FIG. **4*b* light from a light source 44, which lies next to the light source 38, is cast by the lens 39 as parallel light obliquely upon the disc 40. As a result of this, a broader shadow 45 is cast on the strip of light-sensitive elements 43. In the event that the disc 40 wobbles, the narrowest possible shadow could be cast, not by means of the light source 38, as shown, but by means of the light source 44 instead, so that the effective thickness of the disc can be determined even in the event of a wobbling disc. The shadow can be cast on the strip of light-sensitive elements 43** either directly or by means of a lens.

Figure 5:
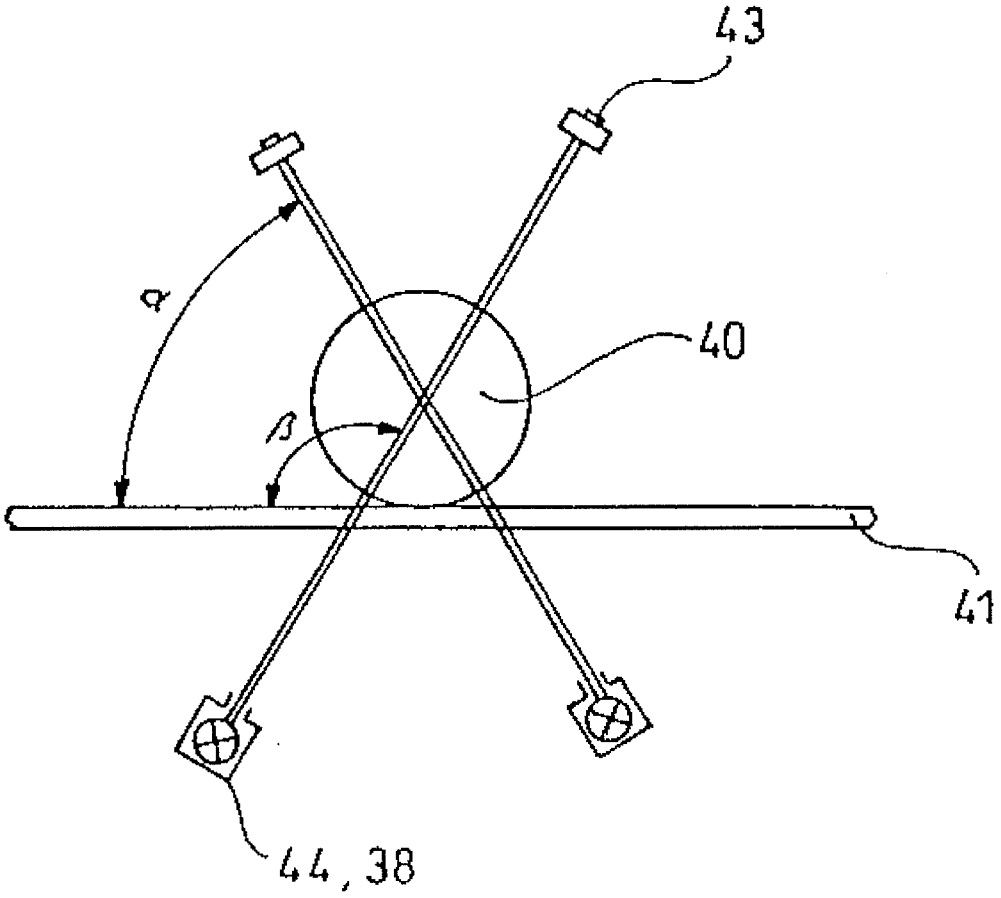
FIG. 5 shows a thickness gauge with multiple measuring systems.

FIG. 5 shows that further thickness measuring systems of the type just described can also be arranged at differing angles α, β to the guide 41, so that the disc 40 is measured simultaneously by several thickness measuring systems. If the disc is not within the required thickness tolerance, it is pushed from the guide 41 into the reject collection pit 19 in the same way as was described earlier with the diameter gauge.

In summary, the invention provides a possibility for checking a large number of discs or disc-like objects without touching them or handling them in any other way, as a result of which, piece counts can be attained that were not attainable until now.

It will be appreciated by those skilled in the art that changes could be made to the embodiment described above without departing from the broad inventive concept thereof.

It is understood, therefore, that this invention is not limited to the particular embodiment disclosed, but it is intended to cover modifications within the spirit and scope of the present invention as defined by the appended claims.

We claim:

1. A testing apparatus for substantially round discs comprising a guide (15, 23, 41) that supports the discs at their circumference and on at least one of their sides for movement past at least a gauge (16) for determining diameter and roundness by determining a plurality of radii of the disk comprising two rows (24, 25) of light-sensitive elements on a surface or along the gauge, said elements being arranged on one side of a major plane of the discs and essentially parallel to the plane in such a way that at least one of the rows (24, 25) essentially runs along the guide (23); a light source (20) arranged on an opposite side of the plane of the discs and that casts light (21) onto the light-sensitive elements (24, 25); and an evaluation unit (29) that processes signals generated by the light-sensitive elements (24, 25).

2. Apparatus in accordance with claim 1, wherein one of the rows (24) is arranged parallel to a part of the guide (23) that supports the discs at their circumference, and the other strip (25) is arranged approximately at a right angle to the first strip (24).

3. Apparatus in accordance with claim 1, wherein the light source (20) emits flashes of light.

4. Apparatus in accordance with claim 1, wherein the light-sensitive elements (24, 25) transmit signals intermittently.

5. Apparatus in accordance with claim 1, wherein the height between one row (24) and a part of the guide (23) that supports the discs at their circumference is less than four-fifths of a disc diameter.

6. Apparatus in accordance with claim 1, further comprising a thickness gauge (17) which has at least one measuring system comprising (a) an area of light-sensitive elements (43) arranged one of above and below the guide (41) and essentially perpendicular to a major plane of the discs; (b) an area of several light sources (38, 44) that cast parallel light on the light-sensitive elements (43), said light sources being arranged on an opposite side of the guide (41) and parallel to the area of light-sensitive elements (43); and (c) an evaluation unit that processes the signals generated by the light-sensitive elements (43).

7. Apparatus of claim 1 further comprising an inclined chute surface (6) connected before the guide and onto which the discs (4, 11, 13) can be fed from a lying position above, and at least one collecting track (7, 10) which is inclined with respect to the horizontal and over which the discs run until the track transitions into the guide (15, 23, 41) at a lower-lying end of the track.

8. Apparatus in accordance with claim 7, wherein the chute surface (6) is inclined at angle between 10° and 70° relative to the perpendicular.

9. Apparatus according to claim 7, wherein the chute surface (6) is inclined at an angle of approximately 25° relative to the perpendicular.

10. Apparatus in accordance with claim 7, wherein the collecting track (7, 10) is inclined at an angle between 10° and 60° relative to the horizontal.

11. Apparatus in accordance with claim 7, wherein the collecting track (7, 10) is inclined at an angle of approximately 30° relative to the horizontal.

12. Apparatus in accordance with claim 7, wherein the collecting track (7, 10) has a width that is smaller than a radius of the discs (4, 11, 13) but greater than their thickness.

13. Apparatus in accordance with claim 7, wherein at the lower lying end following the collecting track (7, 10) there is provided a separating section (14) that has a width that is less than or equal to a disc thickness.

14. Apparatus in accordance with claim 13, wherein the separating section (14) can be adjusted transverse to the chute surface (6).

15. Apparatus in accordance with claim 7, wherein the collecting track (7, 10) is secured to the chute surface (6) in a detachable and exchangeable fashion.

16. Apparatus in accordance with claim 7, wherein the collecting track has recesses in a side that faces the chute surface.

17. Apparatus in accordance with claim 7, wherein chute surface (6) has pneumatically controlled blowing jets in a region of the collecting track (7, 10).

18. Apparatus in accordance with claim 7, wherein the chute surface (6) has an overflow trough (12) at a lower edge thereof.

19. Apparatus in accordance with claim 7, wherein the testing apparatus has an ejection unit arranged after the gauge (16, 17).

20. Apparatus in accordance with claim 7, wherein the guide terminates in a collection pit for discs approved by the testing apparatus.

21. A testing apparatus for substantially round discs comprising a guide (15, 23, 41) that supports the discs at their circumference and on at least one of their sides for movement past at least a thickness gauge (17) which has at least one measuring system comprising (a) an area of light-sensitive elements (43) arranged one of above and below the guide (41) and essentially perpendicular to a major plane of the discs; (b) at least one light source (38, 44) that casts parallel light on the light-sensitive elements (43), said light source being arranged on an opposite side of the guide (41) and parallel to the area of light-sensitive elements (43); and (c) an evaluation unit that processes the signals generated by the light-sensitive elements (43).

22. Apparatus in accordance with claim 21, wherein the several light sources (44, 38) emit a light flash only at a time.

23. Apparatus in accordance with claim 21, further comprising a chute surface (6) connected before the guide and onto which the discs (4, 11, 13) can be fed, wherein the chute surface (6) that supports the discs to their side in a region between the light-sensitive elements (43) and the light sources (44, 38) have recesses, and the guide (41) that supports the discs at their circumferences is tapered with respect to its width in this region.

24. Apparatus in accordance with claim 21, wherein the thickness gauge (17) comprises at least two measurement systems arranged at an angle to one another.

25. Apparatus in accordance with claim 23, wherein the ejection unit comprises at least one of an electromagnet that generates an eddy current and an air jet (18, 26), arranged in a region of the chute surface (6) of the guide that supports the disc at its side.

26. Apparatus in accordance with claim 23, wherein a reject collection pit (19) is assigned to the ejection unit.

* * * * *